US005438320A

United States Patent [19]

Taylor

[11] Patent Number: 5,438,320

[45] Date of Patent: Aug. 1, 1995

[54] PERSONAL ALARM SYSTEM

[75] Inventor: William R. Taylor, Williamsville, N.Y.

[73] Assignee: Figgie International Inc., Willoughby, Ohio

[21] Appl. No.: 45,376

[22] Filed: Apr. 9, 1993

[51] Int. Cl.[6] ..... G08B 23/00

[52] U.S. Cl. ..... 340/573; 200/61.45 R; 340/529

[58] Field of Search ..... 340/573, 689–690, 340/669, 586, 529, 530, 575–576, 671–672, 441; 250/222.1, 229; 200/61.45 R, DIG. 2; 128/782, 721

[56] References Cited

U.S. PATENT DOCUMENTS

| | | | |
|---|---|---|---|
| 3,129,347 | 4/1964 | Tognola | 310/15 |
| 3,304,434 | 2/1967 | Koster | 340/672 X |
| 3,509,298 | 4/1970 | Kirk | 200/61.45 R |
| 3,539,740 | 11/1970 | Isenor et al. | 200/61.45 R |
| 3,588,858 | 6/1971 | Demuth | 340/502 |
| 3,631,433 | 12/1971 | Dix | 340/509 |
| 3,668,526 | 6/1972 | Raskin | 455/18 |
| 3,677,077 | 7/1972 | Merrymann et al. | 73/146 |
| 3,742,478 | 6/1973 | Johnson | 340/539 |
| 3,745,815 | 7/1973 | Bentone et al. | 73/593 |
| 3,962,696 | 6/1976 | Smith et al. | 340/530 |
| 3,999,178 | 12/1976 | Hamilton | 340/529 |
| 4,057,791 | 11/1977 | Bimmerle et al./ | 340/571 |
| 4,110,741 | 8/1978 | Hubert et al. | 340/573 |
| 4,121,160 | 10/1978 | Cataldo | 340/573 X |
| 4,144,531 | 3/1979 | Anbergen | 340/575 |
| 4,196,429 | 4/1980 | Davis | 340/669 |
| 4,218,763 | 8/1980 | Kelley et al. | 340/539 X |
| 4,292,630 | 9/1981 | Dumont | 340/573 |
| 4,331,953 | 5/1982 | Blevins et al. | 340/539 |
| 4,418,337 | 11/1983 | Bader | 340/571 |
| 4,450,437 | 5/1984 | Ho | 340/540 |
| 4,468,656 | 8/1984 | Clifford et al. | 340/539 |
| 4,484,186 | 11/1984 | Wood et al. | 340/689 |
| 4,507,654 | 3/1985 | Stolarczyk et al. | 340/545 |
| 4,524,243 | 6/1985 | Shapiro | 340/573 X |
| 4,591,708 | 5/1986 | Shu | 250/221 |
| 4,665,385 | 5/1987 | Henderson | 340/539 |
| 4,667,188 | 5/1987 | Schwartz | 340/689 |
| 4,688,025 | 8/1987 | Frank | 340/571 |
| 4,736,196 | 4/1988 | McMahon et al. | 340/573 |
| 4,794,536 | 12/1988 | Eto et al. | 340/576 X |
| 4,972,078 | 11/1990 | Hasebe et al. | 250/229 |
| 4,978,946 | 12/1990 | Nordholm et al. | 340/573 |
| 5,045,839 | 9/1991 | Ellis et al. | 340/539 |
| 5,157,378 | 10/1992 | Stumberg et al. | 340/521 |

FOREIGN PATENT DOCUMENTS

| | | | |
|---|---|---|---|
| 0020165 | 12/1980 | European Pat. Off. | 340/573 |
| 0158781 | 10/1985 | European Pat. Off. . | |
| 2532504 | 1/1977 | Germany | 340/573 |
| 2848747 | 5/1980 | Germany | 340/573 |
| 919765 | 2/1963 | United Kingdom | 340/573 |

OTHER PUBLICATIONS

Ellis Cohen Distress Signal Unit, Jun. 1979.

*Primary Examiner*—John K. Peng
*Assistant Examiner*—Thomas J. Mullen, Jr.
*Attorney, Agent, or Firm*—Jones, Day, Reavis & Pogue

[57] ABSTRACT

A motion responsive alarm system including a motion sensor having a housing with a rotatable disk therein, a slot in the disk and a ball bearing in the slot and being loosely confined within an annular chamber in the housing surrounding the disk. The disk contains a plurality of orifices which pass between an LED on one side of the disk and a phototransistor on the other. A signal from the phototransistor is sent to a triggering circuit by interrupting light transfer between the LED and the phototransistor. The circuit includes a novel oscillator having a duty cycle of 10% which drives the LED in the sensor. An alternate state device is coupled to the sensor and the oscillator for generating alternate state outputs only during sensing of motion. A one-shot circuit generates a motion pulse each time motion is sensed. A pulse interval timer and gate determine if the pulses are to be gated to a timer or blocked. The timer is reset by these pulses and does not generate an alarm unless a predetermined period of time passes. The device may be coupled to a self-contained breathing apparatus and is energized only when the breathing apparatus mask is being worn by the user.

29 Claims, 3 Drawing Sheets

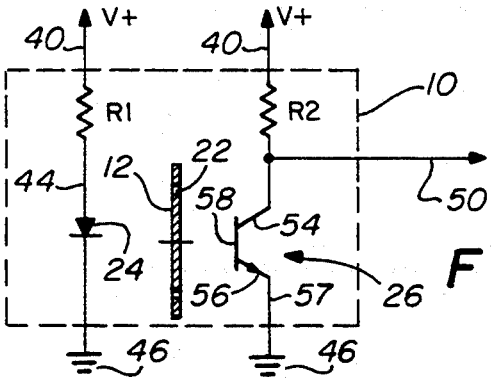
FIG. 6
| a | b | d |
|---|---|---|
| 0 | 0 | 1 |
| 0 | 1 | 1 |
| 1 | 0 | 1 |
| 1 | 1 | 0 |
FIG. 7D
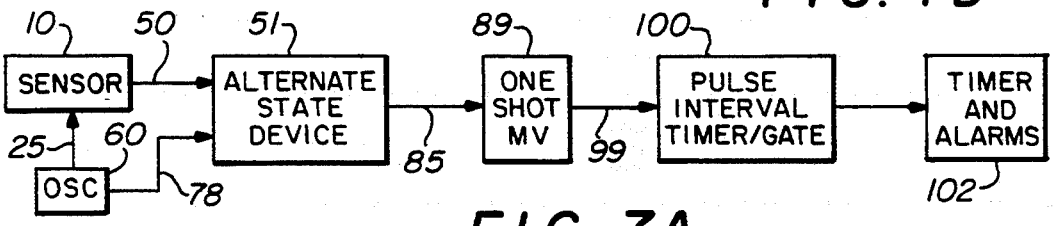
FIG. 7A
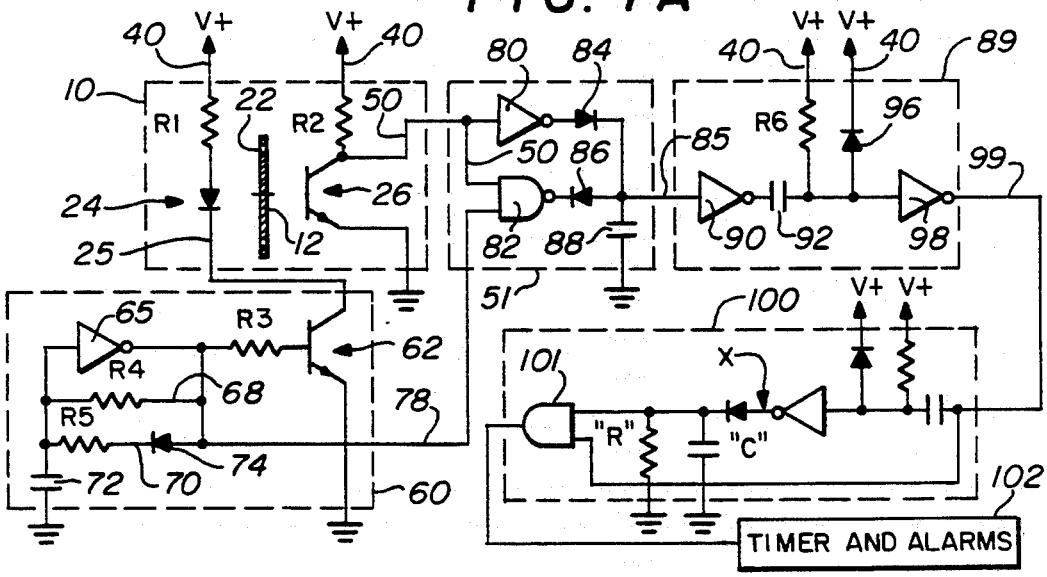
FIG. 7B
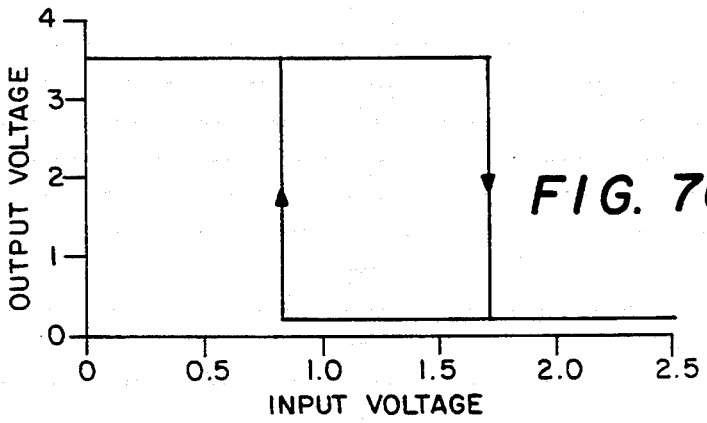
FIG. 7C

PERSONAL ALARM SYSTEM

BACKGROUND OF THE INVENTION

1. Field of the Invention

The present invention relates in general to a personal alarm system and specifically to a personal alarm system that includes an interval motion sensor used with a self-contained breathing apparatus such that the motion sensor will set off an audible alarm if motion of the person wearing the breathing apparatus ceases for a predetermined period of time.

2. Description of the Prior Art

There are many instances in which it would be important to have a device that could initiate an audible alarm if motion of a person wearing the device ceases for a predetermined period of time. The intent of this type of device is to enable potential rescuers to locate an individual who may be trapped and who may have lost consciousness during entrapment.

There are many devices in the art which attempt to provide this type of information. In U.S. Pat. No. 5,157,378, issued to Stumberg et al., a motion sensor is associated with pressure and temperatures sensors to provide audible alarms if the pressure in a self-contained breathing apparatus decreases, if the temperature exceeds a certain value or if motion ceases for a predetermined period of time.

U.S. Pat. No. 4,196,429 to Davis has a motion sensor in the hat of a fireman or other worker in a dangerous environment which includes a mechanical sensor, electrical circuitry and alarm system self-contained therein so that the alarm will sound or be otherwise given in an absence of motion for a predetermined period of time thus indicating disablement of the worker or other individual.

There are many problems associated with the prior art devices. Since the device needs to produce an alarm if the movement of the wearer stops for a period of time long enough to assume he cannot move, a human motion detector device is at the core of the needed device. Further, characterization of human motion is difficult at best, but for this product, quantifying the motion is not necessary since a "lack of motion" is what really needs to be detected. It is assumed that human movement is detectable in all three axes simultaneously but detecting a motion in two axes is thought to be sufficient. Further, a sensor for human motion detection needs to be operable with very low mechanical energy input since acceleration associated with human motion can be low amplitude and low frequency. A pendulum principle will function properly because a pendulum typically produces a low frequency oscillatory motion which is sustained by a low energy input. Further, to monitor pendulum motion, opto-electronics are desirable since light-emitting diodes and phototransistors are available in myriads of configurations, are inexpensive, small and do not require mechanical contact. If mechanical contacts were used, a hermetic seal should be provided. An electronic circuit for such device having a phototransistor signal as an input should sense motion throughout all 360° in one plane or about one axis. The resolution of the detection depends on the mechanics of the device.

SUMMARY OF THE INVENTION

The present invention provides a motion sensor system in which the sensor itself comprises a housing having a hollow chamber therein. A rotatable disk is mounted in the hollow chamber for free rotation about an axis. A plurality of spaced orifices are arcuately arranged in the rotatable disk. A weight within the housing is eccentrically coupled to the freely rotatable disk such that acceleration of the housing causes the weight to rotate the disk about the axis. A light source on one side of the disk is in alignment with the arcuate path formed by the orifice in the disk and a light detector is placed on the other side of the disk such that the light from the light source to the light detector through an orifice is interrupted by rotation of the disk when the housing is moved substantially simultaneously along at least two orthogonal axes thereby causing the light detector to generate an output electrical signal. Thus a mass such as a ball bearing is mounted within a slot in a disk that is mounted in the housing for rotation. The ball is loosely confined within an annular chamber in the housing surrounding the disk. The disk contains a plurality of orifices or windows which must pass between an LED on one side of the disk and phototransistor on the other side of the disk. A signal from the phototransistor is sent to a triggering circuit each time one of the holes or orifices in the disk is aligned between the LED and the phototransistor.

The motion sensor senses motion in a direction perpendicular to the disk because the ball is loosely contained within the annular chamber and the slot in the disk. The width of the slot and, thus, the looseness of the fit of the ball in the slot is one feature that determines the sensitivity of the device. The device is designed to be used with a self-contained breathing apparatus and is designed such that mere breathing does not constitute movement of the person insofar as the sensor is concerned.

The disk is free to make and break light contact because of the openings in the disk, thus triggering the sensation of movement. In other words, a given orifice can move in and out of line between the LED and the phototransistor in a back-and-forth manner creating the sensing movement by the sensor. The sensor does not require that the ball move from one orifice to the next in order to sense movement.

The ball may move an orifice into the light beam, reverse its direction and move the orifice out of the light beam, reverse again and move the same orifice back into the light beam, thus sensing movement.

The ball slot being wider than the ball, however, requires a predetermined amount of movement for the above to occur, thus reducing sensitivity to vibratory movement not associated with human movement.

A pulse interval timing circuit is also employed, which will block the motion pulses unless they occur at a predetermined rate or faster, for example, a third of a second apart or faster. When the disk is still (no movement) and the ball begins to move setting the disk into motion, the first motion pulse due to an orifice crossing the light beam will be blocked. The second pulse will not be blocked, nor will others that follow, if they occur within the timed intervals. Together the interval timer and the slot width provide a means to control the sensor's sensitivity to vibration and very slow movement, both of which are undesirable to be detected as human movement. The absence of motion in the present scheme is detected by a 20-second resettable timing circuit. The motion pulses that occur because of disk rotation and that are spaced close enough in time so they are not blocked by the interval timer, reset this 20-second timer. If no reset occurs for the full 20 seconds, an alarm sequence is initiated.

When the infrared light from the LED strikes the phototransistor through an opening or orifice in the rotating disk, the output signal is near zero volts. When the moving disk blocks light to the phototransistor, the output signal is near the power supply voltage. Of course, the rotation of the disk requires motion of the sensor and therefore a changing output signal indicates motion.

While the above-described device is all that is necessary to obtain an indication of motion, the circuit draws about 20 milliamps continuous current for the LED which is undesirable for a battery-operated sensor for a self-contained breathing apparatus. Therefore, to reduce the LED current substantially, the LED is turned ON substantially 10% of the time and OFF substantially 90% of the time at around 100 hertz. Thus, the LED is ON one millisecond and OFF nine milliseconds, for example. While the ON pulse is 20 milliamps, with the above duty cycle, the average is 2 milliamps which is acceptable. At 100-hertz repetition rate, it is well known that there will be one or more pulses during the time that an open window in the disk allows light to go through even for the most active motion and, therefore, the fastest rotation expected of the disk.

The current reduction technique set forth above presents a problem in that the phototransistor cannot tell whether the LED is turned OFF or ON electrically or that the disk windows are interrupting the light beam. The present invention solves that problem by providing an output only when there is motion.

A microprocessor may be used to provide the functions for the alarm circuit. The microprocessor would replace the discrete components described hereafter. The same motion sensor functions and control principles would result. The microprocessor provides a 10% LED ON time, window or orifice identification is performed by analyzing the pulses emitted by the sensor, a state change for light-to-dark and dark-to-light transitions is detected, the detections are timed as in the pulse interval timer and gate circuit and the alarm is or is not initiated by the same criteria. All control functions are controlled by the microprocessor. Thus, the same results achieved by the discrete components are achieved by the microprocessor.

Thus the present invention relates to a motion-responsive alarm system comprising a self-contained breathing apparatus including an oxygen source, a face mask and a conduit coupling the oxygen source to the mask, a device mounted on the self-contained breathing apparatus for selectively enabling the system and allowing oxygen to be coupled from the source to the mask, a motion sensor coupled to the self-contained breathing apparatus for generating a signal representing motional disturbances, an alternate state output signal device coupled to the motion sensor for receiving the generated signal and alternately switching its output between a first state and a second state only when motion is occurring, an output device coupled to the alternate state device for generating a motion pulse each time the alternate state device switches between the first and second states, an interval timer to block the motion pulses unless successive pulses are sufficiently close in time, a timer coupled to the interval timer for receiving the motion pulses, the timer being reset by the motion pulses and generating an alarm signal only when the timer is not reset during a predetermined period of time, and a switching device responsive to operation of the system enabling device for energizing the motion responsive alarm system only when the system is enabled.

The invention also relates to a motion sensor comprising a housing having a hollow chamber therein, a rotatable disk mounted in the hollow chamber for free rotation about an axis, a plurality of spaced arcuately arranged orifices in the rotatable disk, a weight within an annular chamber in the housing and eccentrically coupled to the freely rotatable disk such that acceleration of the housing causes the weight to rotate the disk about the axis, and a light source on one side of the disk in alignment with the arcuate path formed by the orifices in the disk and a light detector on the other side of the disk such that the light from the light source to the light detector through an orifice is interrupted by rotational movement of the disk when the housing is moved thereby causing the light detector to generate an output electrical signal.

The invention also relates to a motion responsive alarm system having a power saving circuit comprising a Schmitt trigger inverter having an input and an output for generating an output signal, a capacitor coupled between the inverter input and ground potential, first and second parallel resistors, R1 and R2, coupling the output of the inverter to the input of the inverter and to the capacitor, the first resistor, R1, having a resistance X times the resistance R2, and a diode in series with only resistance R2 to allow the capacitor to charge through both resistors R1 and R2 to a first level and cause the inverter to generate a first level output and to continue to charge the capacitor to a second level and cause the inverter to generate a second level output and discharge the capacitor only through resistance R1 so as to cause the oscillator to have a duty cycle of R1/R2, thereby causing the oscillator to be ON and provide and output signal 1/X of the time and be turned OFF (X−1/X) of the time.

A transistor is used to turn ON the LED and has a first terminal coupled to the inverter output, a second terminal coupled to ground potential and a third terminal coupled to the LED for generating an oscillator output signal.

BRIEF DESCRIPTION OF THE DRAWINGS

These and other objects of the present invention will be more fully disclosed when taken in conjunction with the following DETAILED DESCRIPTION OF THE DRAWINGS in which like numerals represent like elements and in which:

FIG. 6 is a schematic electrical diagram of the electrical system of the motion sensor of the present invention;

FIG. 7A is a generalized block diagram of the present alarm system;

FIG. 7B is a circuit diagram of the entire motion responsive alarm system of the present invention;

FIG. 7C is a graph of waveforms illustrating the operation of the oscillator Schmitt trigger of the present invention;

FIG. 7D is a truth table for the operation of the NAND gate of the alternate state circuit;

DETAILED DESCRIPTION OF THE DRAWINGS

Figure 1:
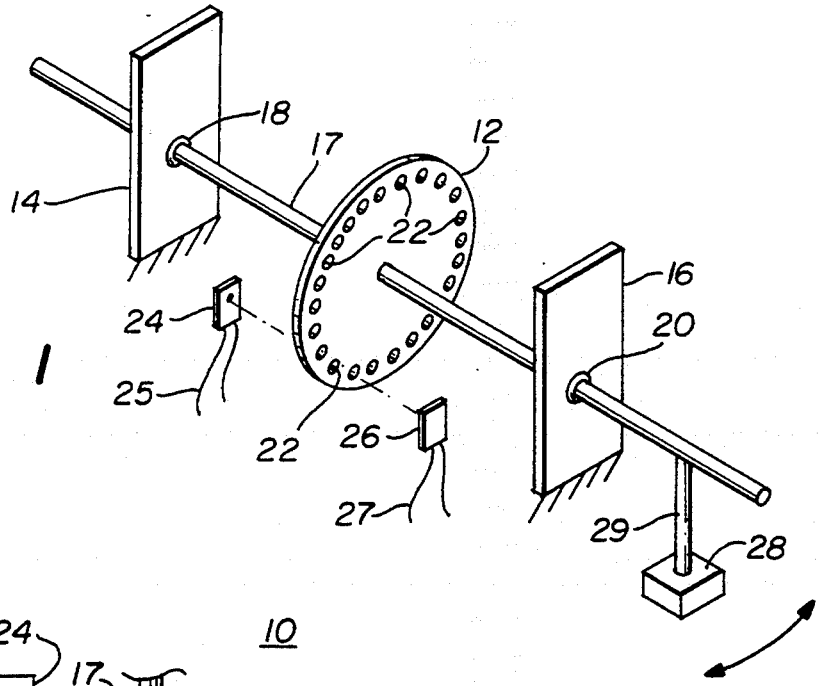
FIG. 1 is a schematic diagram of the proposed novel motion sensor in a general representation.

FIG. 1 is a general schematic drawing illustrating the principles of the novel motion sensor disclosed herein. As can be seen in FIG. 1, the motion sensor 10 includes a rotatable disk 12 mounted in housing walls 14 and 16 for free rotation on shaft 17 mounted in bearings 18 and 20. The disk 12 has a plurality of spaced orifices 22 arcuately arranged in the rotatable disk. A weight 28 is eccentrically coupled to the freely rotatable disk 12 by means of arm 29 such that movement of the housing walls 14 and 16 cause the weight 28 to rotate the disk 12 about the axis formed by shaft 17. A light source 24, such as a light-emitting diode, is placed on one side of the disk 12 in alignment with the arcuate path formed by the orifices 22 in the disk 12 and a light detector 26 is placed on the other side of the disk 12 such that the light from the light source 24 to the light detector 26 through an orifice 22 is interrupted by rotation of the disk 12 when the housing walls 14 and 16 are accelerated along at least one of two orthogonal planes thereby causing the light detector to generate an output electrical signal on lines 27. The LED is powered by current applied to input leads 25.

It can be seen that an electronic circuit receiving the phototransistor signal on line 27 as an input would sense motion throughout all 360° in one plane or axis. While this concept works well with the axis 17 as drawn in FIG. 1, when the axis of rotation 17 is in the vertical plane, at 90°, the mass 28 puts a side load on the bearings 18 and 20 thus impeding low energy motion.

Figure 2:
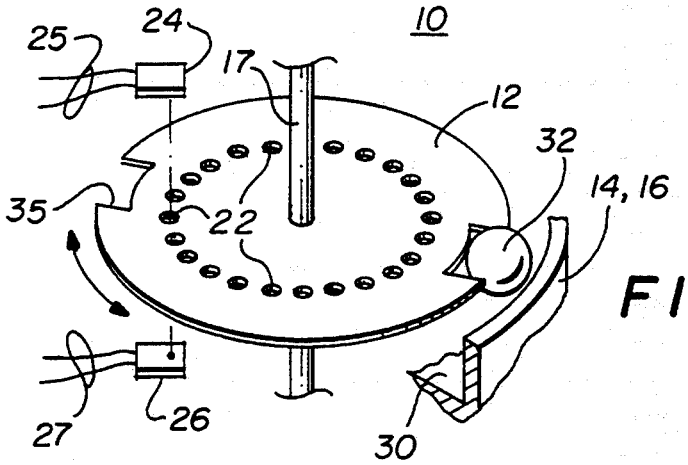
FIG. 2 a schematic diagram of the preferred embodiment of the motion sensor of the present invention.

The schematic diagram of the motion sensor 10 shown in FIG. 2 obviates this problem. As can be seen in FIG. 2, a slot 34 extends inwardly from the periphery of disk 12 and a spherical mass or ball 32 is captured in the disk slot 34 and retained in an annular channel 30 to enable movement of the mass 32 such that movement of the housing 14, 16 causes the spherical mass 32 to roll in the channel 30 thereby rotating the disk 12 and causing the spaced orifices 22 to interrupt the light from LED 24 reaching the light detector 26. It can be seen in such case that the weight of the ball 32 rests on the surface of channel 30 and thus provides no side load on the bearings 18, 20 that hold shaft 17. In the preferred embodiment, the spaced orifices or windows 22 are at 15° increments at a 0.830 inch radius. Of course, other dimensions could be used under various conditions.

Further, an additional slot 35 is added to the disk 12 to balance the disk 12 and compensate for the material removed for slot 34. Otherwise the disk 12 would be unbalanced because of the weight of the material removed for slot 34.

Figure 3:
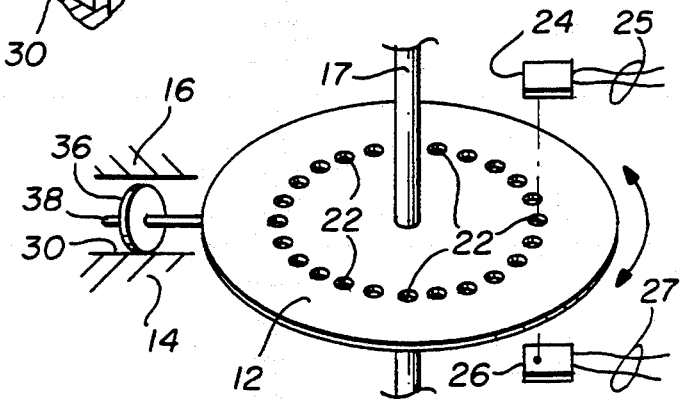
FIG. 3 is a general schematic of an alternate version of the motion sensor herein.

An alternate version of the motion sensor is illustrated in FIG. 3 wherein a wheel 36 has mass and is attached to the disk 12 in any well-known fashion at the periphery thereof by means of shaft or arm 38. The wheel 36 rests on the surface of channel 30 of housing walls 14 and 16 and thus does not provide a side load since the weight of the mass 30 downwardly is absorbed by the channel 30 in which it rotates.

Figure 4:
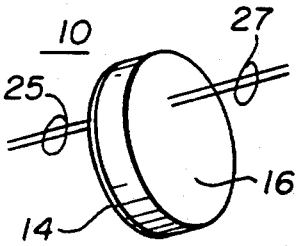
FIG. 4 is an isometric view of the assembled motion sensor of the present invention.
Figure 5:
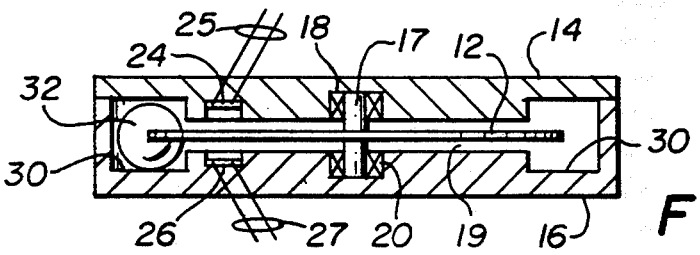
FIG. 5 is a generalized cross-sectional view of the motion sensor of FIG. 4.

FIG. 4 is an isometric view of the preferred embodiment of the entire motion sensor 10. The motion sensor 10 includes first and second opposed mating housing halves 14 and 16 with an annular channel 30 therein as illustrated in FIG. 5. The LED 24 is mounted in one housing half 14 with the input leads 25 extending therefrom as shown in FIG. 4 while the phototransistor 26 is mounted in the housing half 16 with its output leads 27 extending therefrom. In a preferred form, the motion sensor 10 would be mounted on a self-contained breathing apparatus (SCBA) back frame with the plane of the disk 12 oriented 60° from the horizontal and lying along a line representing normal forward motion of a person, ie, the edge of the disk would face forward in the direction of forward movement.

FIG. 5 is a cross-sectional view of the device illustrated in FIG. 4. The two housing halves 14 and 16 of the sensor 10 are shown mounted together in mating relationship to form a housing having a hollow chamber 19 therein. A rotatable disk 12 is mounted in the hollow chamber 19 for free rotation about an axis formed by shaft 17 on which the disk 12 is mounted. Shaft 17 is mounted in bearings 18 and 20 for free rotation. An annular channel 30 is formed in the housing and extends about the periphery of the disk 12. The ball 32 is a spherical mass that is captured in the disk slot 34 shown in FIG. 2 and is retained in the annular channel 30 to enable movement of the ball 32 such that acceleration of the housing formed by the halves 14 and 16 causes the ball 32 to roll in channel 30 thereby rotating the disk 12 and causing the spaced orifices 22 therein to interrupt the light from light source 24 reaching the light detector 26 on the opposite side of disk 12. The light source or LED 24 may operate in the infrared frequency range and the photodetector 26 is of a type well known in the art that can detect such light.

The circuit of the motion sensor 10 of FIG. 5 is illustrated in FIG. 6. The light-emitting diode 24 is powered from a voltage source 40 through a resistor R1 and diode 24 to ground 46. Operation of the LED requires 20 milliamps of current. The disk 12 with orifices 22 is inserted between the LED 24 and the phototransistor 26. Phototransistor 26 is powered from voltage source 40 through resistor R2 to its collector 54. When light from LED 24 passes through an orifice 22 and strikes the light receiving portion 58 of the phototransistor 26, it conducts through emitter 56 on lead 57 to ground 46 thus causing a voltage drop across resistor R2 and an output signal is produced on line 50.

It will be clear when reviewing the relationship of the slot 34 of disk 12 and the rotating ball 32 that the width of slot 34, in relation to the diameter of the rotating ball 32, provides a control of the inherent sensitivity of the device. In the preferred embodiment, the ball or mass 32 has a diameter of 0.312 inches and the slot width is equal to the ball diameter plus an additional amount in the range of 5% to 100% of the ball diameter. Thus a wider slot lets the ball 32 move about to a greater degree without moving the disk. This can be used to control sensor sensitivity which is necessary since a nonmoving individual or user may still produce some regular motion such as breathing.

FIG. 7A is a block diagram of the complete opto-electronic motion detector circuit. It includes a sensor 10 as described previously that generates a signal representing motional disturbances.

Oscillator circuit 60 provides driving signals to sensor 10 on lead 25 to cause a pulsed output signal on line 50 from the sensor whenever light from the LED 24 passes through an orifice 22 to phototransistor 26. An alternate state device 51 receives the pulsed output signals from the sensor 10 on line 50 and the signals from oscillator circuit 60 on line 78 and alternately switches its output on line 85 between a first state and a second state only when motion is occurring as detected by sensor 10. A one-shot multivibrator circuit 89 serves as an output device and is coupled on line 85 to the alternate state device 51 and generates a motion pulse on line 99 only when the alternate state device 51 switches from the first state to the second state. A pulse interval timer/gate receives the motion pulse on line 99 from the multivibrator (MV) and starts another pulse after the motion pulse is complete (trailing edge of motion pulse). The second pulse charges a capacitor which has a predetermined discharge time (i.e., ⅓ second). The output signal from the resistor/capacitor (RC) is "ANDED" with the original motion pulse (line 99). If the AND is satisfied, the motion pulse on line 99 goes on to timer and alarm circuit 102. If it is not satisfied (the capacitor has discharged), the motion pulse is blocked by the AND gate. The unblocked pulse resets the resettable timer of time and alarm circuit 102. Circuit 102 will generate an alarm signal only when the timer therein is not reset during a predetermined period of time. Thus, the trailing edge of the motion pulse on line 99 starts a new pulse on the line designated by the letter "X". The pulse at "X" charges capacitor "C" which is discharged by resistor "R". "C" must remain charged for the pulse on line 99 to pass through the AND gate 101 to timer and alarm circuit 102. If "C" is discharged, the first pulse on line 99 will not pass the AND gate 101 to timer and alarm circuit 102.

FIG. 7B discloses the details of the block diagram circuit illustrated in FIG. 7A. As can be seen in FIG. 7B, the opto-electronic motion sensor 10 includes the light-emitting diode 24 and the light detector 26. A voltage source 40 is coupled to the light-emitting diode 24 through resistor R1. The cathode side of LED 24 is coupled to the collector of transistor 62 in the oscillator circuit 60. When the infrared light from LED 24 strikes the phototransistor 26 through an opening or window 22 in the rotating disk 12, the phototransistor 26 conducts and the output signal is near zero volts because the voltage from source 40 is all dropped across resistor R2, thus producing essentially zero volts on line 50 as an output. When the moving disk 12 blocks light to the phototransistor 26, the output signal is near the source voltage 40 since the phototransistor 26 ceases to conduct. Of course, the rotation of the disk requires motion of the sensor 10 and therefore a changing output signal on line 50 indicates motion. The system functions properly whether the window 22 causes the received light of the phototransistor 26 to go from light to dark or from dark to light.

Schmitt trigger inverter 65, such as type 40106A, along with resistors R4, R5, diode 74 and capacitor 72 form an oscillator. This arrangement oscillates because of the use of the Schmitt trigger inverter device 65. While standard inverters and gates have only one input threshold voltage that causes the output to switch, Schmitt-trigger inverters and gates have two different input threshold voltages: one threshold for when the input is changing from LOW to HIGH and a different threshold for when the input is changing from HIGH to LOW.

Consider FIG. 7C. Assume the input is LOW (0 volts) and the output is HIGH (3.4 volts typical). As the input voltage is increased, the output does not change until the input reaches 1.7 volts as shown in FIG. 7C. At the time the output snaps to the LOW state (0.2 volt typical) and stays LOW for further increases in input voltage. If the input starts in the HIGH state and is reduced toward zero, the output will stay LOW until the input reaches approximately 0.9 volt. The output will then snap to the HIGH state.

The difference between the HIGH threshold (1.7 volts) and the LOW threshold (0.9 volt) is called hysteresis. Of course, the values change for different versions of the inverter and these values stated are for the 54/7414 Schmitt-trigger inverter.

It is undesirable that 20 milliamps of continuous current be provided for the LED because the device is battery operated and battery life would be shortened considerably. Thus to reduce the LED current substantially, it is desirable to turn the LED ON substantially 10% of the time and OFF substantially 90% of the time at around 100 Hz. At 100 kilohertz repetition rate, it is known there will be one or more pulses coupled from the LED to the phototransistor when an open orifice in the disk allows light to pass even for the most active motion and therefore the fastest rotating disk expected. Thus in that case the LED would be ON 1 millisecond and OFF 9 milliseconds. While the ON pulse is then 20 milliamps, the average current is 2 milliamps which is acceptable. To enable the LED to be 10% ON and 90% OFF, diode 74 is placed in series with resistor R5. This allows the oscillator circuit 60 to have a nonsymmetrical output because diode 74 allows charging of the capacitor 72 through both resistors R4 and R5 but allows the capacitor 72 to discharge only through R4. If R5 is 0.1 R4 (R4 is ten times larger than R5), an output results that is HIGH 10% of the time. Thus as the oscillator circuit 60 is functioning, the output of Schmitt trigger inverter 65 is coupled through resistor R3 to the base of transistor 62 thus turning it ON and OFF at a ten percent cycle rate, i.e. 10% ON and 90% OFF. This allows the LED 24 to be 10% ON and 90% OFF. Resistor R3 limits the base current to transistor 62, the function of which is to turn ON the LED as shown in graph waveform (a) of FIG. 10. As illustrated by graph (a) in FIG. 10, the oscillator circuit 60 output pulses shown are those produced when the oscillator circuit 60 is ON 10% of the time and the 20-milliamp LED pulses are at a 10% duty cycle. Resistor R1 in the sensor 10 limits the LED current to 20 milliamps.

Figure 10:
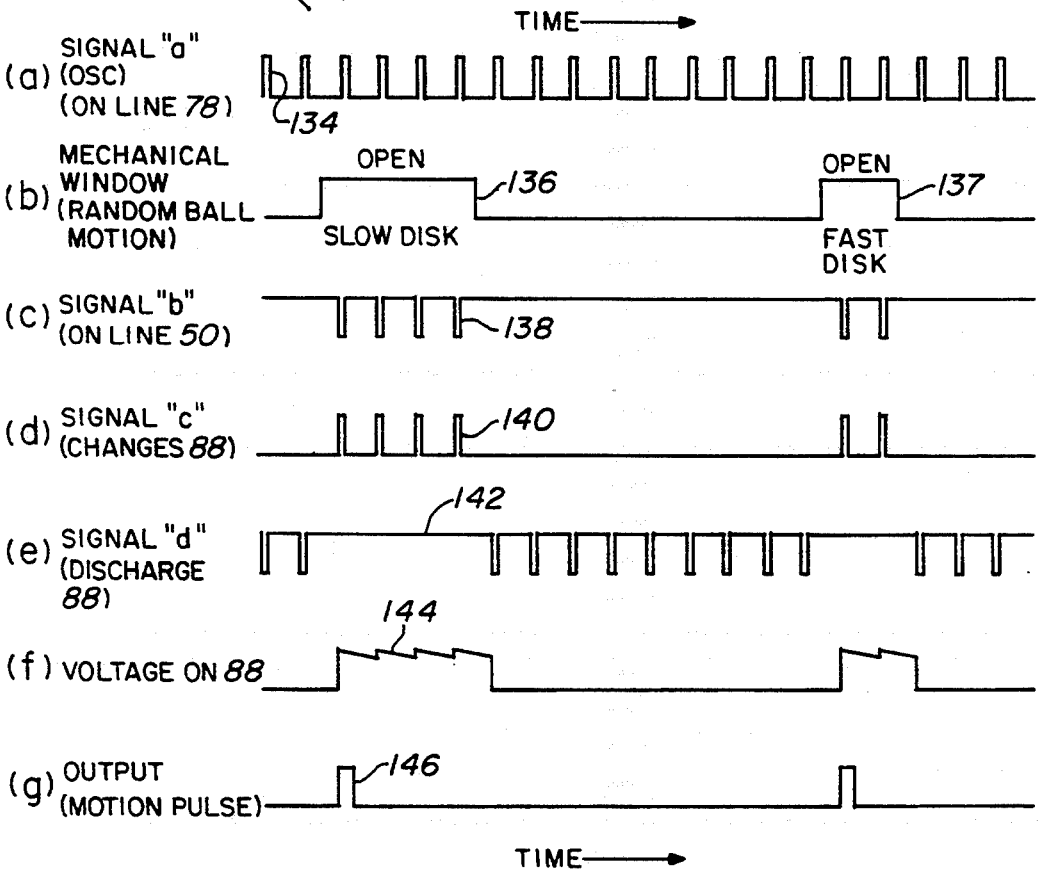
FIG. 10 illustrates waveforms (a), (b), (c), (d), (e), (f) and (g) to explain the operation of the circuit in FIG. 7B.

Graph (b) in FIG. 10 illustrates the orifices 22 or "windows" in the disk 12. With random ball motion, the openings 22 will allow a window 136 in graph (b) during which time pulses from the LED will pass through the "window" to the photodetector 26. If the disk is a "slow disk", the time window may be long as illustrated in waveform 136. If it is a "fast disk", the time window may be slower as illustrated by waveform 137 in graph (b) of FIG. 10.

Thus the output from motion sensor 10 on line 50 is the inverse of the oscillator output on line 78 when a window is present allowing light from the LED 24 to the phototransistor 26. This can be seen by waveforms (a) and (c) in FIG. 10. When the output of the oscillator circuit 60 goes positive, the LED 24 transmits light to the photodetector 26 and the photodetector 26 conducts and the voltage is dropped across resistor R2 thus causing a negative pulse on the output of the motion sensor 10 on line 50. This is shown in waveform (c) as signal "b". The output of the oscillator circuit 60 on line 78 is designated as signal "a" in waveform (a) of FIG. 10 and the output of the sensor 10 on line 50 is designated as the signal "b" shown in waveform (c) of FIG. 10. Thus it can be seen then, in FIG. 10, that the oscillator signals 134 are positive going and the sensor signals 138 are negative going.

The alternate state circuit 51 shown in FIG. 7B includes Schmitt inverter 80, diode 84, NAND gate 82, diode 86 and capacitor 88. The output of Schmitt inverter 80 is illustrated as signal "c" shown in waveform (d) of FIG. 10 and includes pulses 140 that are the inverse of the pulses 138 on line 50 from the output of motion sensor 10. The output of NAND gate 82 is signal "d" illustrated in waveform (e) of FIG. 10. Signal "b" on line 50 and signal "a" on line 78 from the oscillator are coupled to the NAND gate 82. A truth table for the NAND gate 82 is illustrated in FIG. 7D. Thus when signals "a" and "b" are 0, the output signal "d" from NAND gate 82 is a "1". In like manner, if signal "a" is a "0" and signal "b" is a "1", the output of the NAND gate 82 will be a "1". If the signal "a" is a "1" and signal "b" is a "0", the output of the NAND gate will be "1". If both the signals "a" and "b" are a "1", the output of the NAND gate 82 will be a "0". Thus, the output signal "c" from Schmitt inverter 80 charges capacitor 88 through diode 84. These are the pulses 140 shown in waveform (d) in FIG. 10. The voltage on capacitor 88 is illustrated in waveform (f) in FIG. 10. This charging voltage is designated by the numeral 144 in waveform (f).

However, when the window or orifice 22 in disk 12 closes, the input signal "b" to the Schmitt inverter 80 on line 50 ceases and thus the output of the Schmitt inverter 80, signal "c", also ceases. Because there is no signal "b" and there is a signal "a", the NAND gate 82 produces an output according to the truth table in FIG. 7D which allows the capacitor 88 to discharge through diode 86. Thus capacitor 88 charges and discharges as long as there is motion sensed.

This charging and discharging voltage 144 of capacitor 88 is coupled on line 85 to Schmitt inverter 90 in one-shot multivibrator circuit 89. The Schmitt inverter 90, capacitor 92, resistor R6, diode 96 and Schmitt inverter 98 all comprise the one-shot circuit 89. This monostable circuit produces a pulse each time the capacitor 88 is charged in the alternate state device 51. The pulse appearing at the output of Schmitt inverter 98 is the pulse indicating that motion has occurred. See waveform (g), pulse 146 in FIG. 10. The monostable circuit 89 operation occurs when the output of Schmitt inverter 90 goes LOW which causes Schmitt inverter 98 to have an output that is HIGH until capacitor 92 charges through resistor R6. Schmitt inverter 98 then returns to a normal LOW output. When the output of Schmitt inverter 90 goes HIGH, capacitor 92 discharges through diode 96 and the process then can repeat.

Note that a conventional bistable flip-flop circuit could used instead of capacitor 88 in the alternate state device 51 to retain the alternate states. In other words, the output from inverter 80 would set the flip-flop to one state and the output from NAND gate 82 would reset the flip-flop to the opposite state.

The one-shot configuration 89 as described was specifically chosen to benefit from the AC coupling provided by capacitor 92. AC coupling allows the output of Schmitt inverter 98 to be LOW whether the disk 12 stops on an open window 22 (capacitor 88 voltage HIGH) or a closed window 22 (capacitor 88 voltage LOW). The motion pulse occurs then only when capacitor 88 is charged rapidly following a light-to-dark window transition. Clearly, however, the circuit could be designed to charge the capacitor 88 with a dark-to-light window transition.

The motion pulse 146 in waveform (g) of FIG. 10 on line 99 of FIG. 7B at the output of the one-shot circuit 89 causes a new or second similar pulse in the interval timer circuit 100 which is generated by the trailing edge of the motion pulse from the one shot 89. This new or second pulse starts a short timing signal by means of an RC time constant circuit in the interval timing circuit 100 formed by capacitor "C" and resistor "R" which, in turn, arms an AND gate 101. The next motion pulse that occurs while the AND gate 101 is armed will be gated through the AND gate 101 if the RC time constant has not expired and will also again start the timing signal by means of the RC time constant circuit. In like manner, all motion pulses are gated through the AND gate 101 as long as the previous motion pulse was close enough in time so that the RC time constant signal does not time out and disarm the AND gate 101. In this manner, when the disk is still and a vibration or shock might move an orifice into the light beam (light-to,dark transition), the circuit will be insensitive to and reject the resultant motion pulse unless another occurs within the prescribed interval. Very slow motions, whereby windows are interrupting the light beam at a rate less than the prescribed interval, are all rejected until the disk rotation speeds up from a larger motion impetus. Only motion pulses occurring faster than the prescribed rate set by the RC time constant circuit are not blocked and, therefore, reset the 10-second alarm and timer circuit 102, thus preventing initiation of the alarm. The timer circuit of block 102 is well known in the art and will not be described in further detail, as well as the alarm generation means and audible sounding devices.

Figure 9:
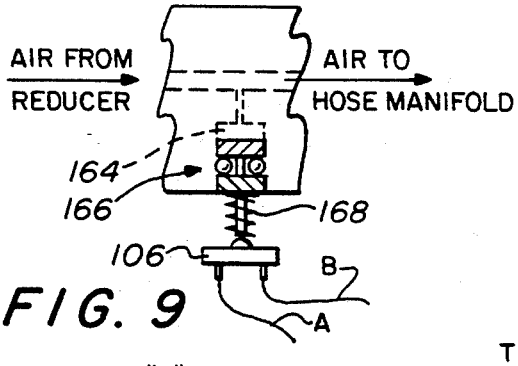
FIG. 9 is a schematic representation of a pressure operated switch used in conjunction with FIG. 8 to turn ON and provide power to the circuit of FIG. 7B when an oxygen mask is placed on a user.
Figure 11:
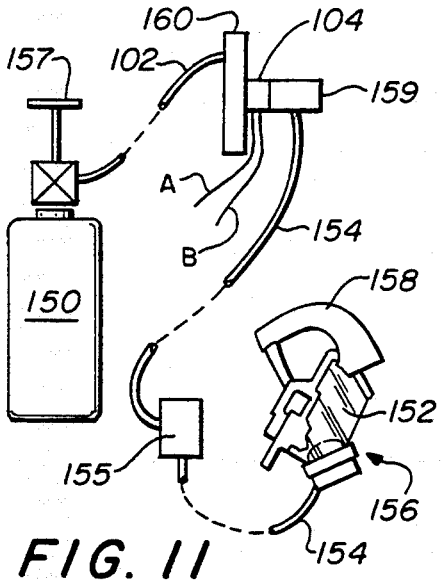
FIG. 11 illustrates a self-contained breathing apparatus which can be used with the circuits of FIGS. 7A and 7B to provide power to the motion sensor system when a user has a mask on his face and is using oxygen.

It may be desirable to couple the operation of the novel opto-electronic motion detector circuit directly to a self-contained breathing apparatus (SCBA). In such case, the motion detector circuit needs to be automatically actuated when the user starts breathing. The biggest problem occurs when the user, such as a fireman, takes a break and sits down and takes off his mask. At that point in time, the motion sensor would activate the alarm after a predetermined period of time (i.e. 20 seconds) and the user would somehow have to turn OFF or disable the unit. If the unit is turned ON and OFF with pressure in the mask, then the system would be operational only when the mask is ON and would not be operational during times when the mask is OFF such as at break times. FIG. 11 discloses a schematic diagram of a conventional SCBA system which has an oxygen tank or source 150 coupled through a bottle valve 157 to a mask 156 of any well-known type. The mask has a face piece or visored portion 152 through which the user can visually observe his surroundings and a strap or head harness 158 to maintain the mask in place on the face. A pressure reducer 160 could be placed anywhere after the air source 150 to reduce the pressure in the high pressure hose 162 to a low value needed to supply a breathing mask. A breathing valve senses the need for air in the mask. The mask hose line 154 is connected to the pressure reducer 160 via the hose line manifold 159. A pressure switch assembly 104, provided to turn ON the motion responsive alarm system, is positioned between the pressure reducer 160 and the hose line manifold 159 so as to be pressurized but not to interfere with the through air for breathing. FIG. 9 discloses operation of pressure switch assembly 104. A cylinder 164 and piston/0-ring assembly 166 are located in the air supply so as not to obstruct the through air but which operate a standard microswitch 106. A return spring 168 is provided so the piston and O-ring assembly 166 will return when the air pressure is reduced to a predetermined value (30 psi) or is shut OFF at the bottle with valve 157.

Figure 8:
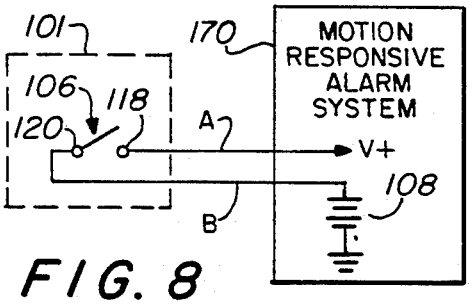
FIG. 8 is a schematic diagram of the electrical switching for powering the system of FIG. 7B in conjunction with a self-contained breathing apparatus.

FIG. 8 shows the schematic of the pressure switch as connected to the motion responsive system. As can be seen by FIGS. 8, 9 and 11, the motion responsive system is ON when the valve 157 of bottle 150 is turned ON and vice-versa. There is a well-known electronics latch circuit in the motion responsive system which keeps the system energized (connected to the battery) after the pressure switch 104 has turned OFF (bottle OFF), until a manual reset switch is depressed.

Thus, there has been disclosed a novel movement sensor comprising a housing having a hollow chamber therein, a rotatable disk mounted in the hollow chamber for free rotation about an axis, a plurality of spaced arcuately arranged orifices in the rotatable disk, a weight within the housing eccentrically coupled to the freely rotatable disk such that acceleration of the housing causes the weight to rotate the disk about the axis. The weight may be a ball bearing or other spherical mass that is captured in a slot in the disk and retained in an annular channel in a housing to enable movement of the mass such that acceleration of the housing causes the spherical mass to roll in the channel thereby rotating the disk and causing the spaced orifices therein to interrupt light from a light source to a light detector.

A light source is placed on one side of the disk in alignment with the arcuate path formed by orifices in the disk and a light detector is placed on the other side of the disk such that the light from the light source to the light detector through an orifice is interrupted by rotation of the disk when the housing is accelerated along at least one of two orthogonal planes thereby causing the light detector to generate an output electrical signal.

The housing is formed of first and second opposed mating halves and includes an annular channel that extends about the periphery of the disk mounted therein. The slot for the spherical mass extends inwardly from the periphery of the disk such that the spherical mass is captured in the disk slot and retained in the annular channel to enable movement of the mass such that acceleration of the housing causes the spherical mass to roll in the channel thereby rotating the disk and causing the spaced orifices to interrupt the light reaching the light detector. The width of the slot may be varied to determine the sensitivity of the sensor. The wider the slot the less sensitive it would be to rotation of the ball.

In an alternate embodiment, an arm or shaft extends radially outwardly from the peripheral edge of the disk with a weight mounted on the outer end of the arm and which movably engages the annular channel such that the weight acts as a pendulum and acceleration of the sensor housing causes the weight to rotate the disk about the axis to interrupt the light reaching the light detector. The weight may be a wheel mounted on the outer end of the shaft that rolls on the surface of the annular channel. The light source may be a light-emitting diode that operates in the infrared frequency range and the light detector is a phototransistor.

The novel motion sensor is used in a motion responsive alarm system in which the output of the motion sensor is coupled to an alternate state output signal device for alternately switching its output between a first state and a second state only when motion is occurring. A one-shot device is coupled to the alternate state device for generating a motion pulse each time the alternate state device switches between the first and second states. The motion pulses are gated by a pulse interval timer means, if they occur at a fast enough rate, after the first pulse which is always blocked since a "rate" cannot be established with one pulse. The pulse interval timer and gate circuit is coupled to a timer reset means and such timer, when not receiving the reset pulses for a predetermined time, will initiate an alarm signal. A pulse interval timer may be placed between the one-shot multivibrator and the alarm circuit to reduce the sensitivity of the motion sensor to vibration.

The device may be used with a self-contained breathing apparatus that includes a device mounted on the self-contained breathing apparatus for selectively enabling the system and allowing oxygen to be coupled from the oxygen source to the mask of the user. A switch responsive to the operation of the system enabling device energizes the motion responsive alarm system only when the self-contained breathing apparatus is operating.

In addition, the motion sensor is driven by a novel oscillator circuit which has a 10-percent duty cycle. In other words, the device is ON 10% of the time and OFF 90% of the time, thereby conserving current. The oscillator utilizes a Schmitt-trigger inverter having an input and an output for generating an oscillator output signal. A capacitor is coupled between the inverter input and ground potential. First and second parallel resistors couple the output of the inverter to the input of the inverter and to the capacitor. The first resistor has a resistance ten times the second resistor. A diode is in series with only the second resistor to allow the capacitor to charge through both resistors to a first level and cause the inverter to generate a first level output and to continue to charge to a second level and cause the inverter to generate a second level output. The diode allows the discharge of the capacitor only through the first resistance which has the larger resistance so as to cause the oscillator to have a duty cycle that is the ratio of the first and second resistors or 10% thereby causing the oscillator to be ON and provide and output signal 10% of the time and to be turned OFF 90% of the time. The LED may be driven by a transistor having a first terminal coupled to the inverter output, a second terminal coupled to the ground potential and a third terminal coupled to the LED for generating an oscillator output signal.

While the invention has been shown and described with respect to particular embodiments thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

I claim:

1. A motion sensor to be worn by a user and comprising:

a housing having a hollow chamber therein;

a rotatable disk mounted for free rotation in the hollow chamber about an axis;

a plurality of spaced arcuately arranged orifices in the rotatable disk;

a weight within the housing coupled to the freely rotatable disk such that movement of the housing causes the weight to rotate the disk about said axis; and a light source on one side of the disk in alignment with the arcuate path formed by the orifices in the disk and a light detector on the other side of the disk such that the light from the light source to the light detector through an orifice is interrupted by rotation of the disk when the housing is moved thereby causing the light detector to generate an output electrical signal.

2. A motion sensor as in claim 1 wherein said housing includes:

an annular channel in the housing extending about the periphery of the disk for receiving the weight.

3. A motion sensor as in claim 2 further comprising:

a slot extending inwardly from the periphery of the disk; and said weight being a spherical mass captured in the disk slot and retained in the annular channel to enable motion of the mass such that movement of the housing causes the spherical mass to roll in the channel thereby rotating the disk and causing the spaced orifices to interrupt the light reaching the light detector.

4. A motion sensor as in claim 3 wherein the spherical mass is a ball bearing.

5. A motion sensor as in claim 3 wherein the width of the slot affects motion and vibration sensitivity of the sensor.

6. A motion sensor as in claim 2 further comprising:

an arm attached to and extending radially outwardly from the peripheral edge of the disk; and said weight being mounted on the outer end of said arm and movably engaging the annular channel such that the weight acts as a pendulum and acceleration of the sensor housing causes the pendulum to rotate the disk about said axis and interrupt the light reaching the light detector.

7. A motion sensor as in claim 6 wherein said weight is a wheel mounted on the outer end of the arm and rolling on the surface of the annular channel.

8. A sensor as in claim 2 wherein the housing includes first and second opposed mating sections forming the hollow chamber and the annular channel.

9. A motion sensor as in claim 1 wherein:

the light source is an LED; and the light detector is a phototransistor.

10. A motion sensor as in claim 9 wherein the LED operates in the infrared frequency range.

11. A motion sensor as in claim 9 further comprising:

an oscillator circuit having an output coupled to the LED for causing the LED to emit light pulses that are transmitted to the light detector and interrupted by the orifices in said disk during movement of the housing; and circuit means in said oscillator circuit for causing said oscillator circuit output to have an ON-OFF duty cycle for generating output pulses only for a predetermined portion of a period of time.

12. A motion sensor as in claim 10 wherein the circuit means for causing the ON-OFF duty cycle of the oscillator circuit comprises:

a Schmitt inverter having an input and generating an output signal;

a transistor coupled to the inverter output, the LED and ground potential for receiving the output signal and turning ON the LED;

a capacitor coupled between the inverter input and ground potential;

first and second parallel resistors, R1 and R2, coupling the inverter output to the inverter input, said first resistor, R1, having a resistance X times the second resistor, R2; and a diode in series with only the second resistor R2 so as to allow the capacitor to charge through both the first and second resistors R1 and R2 but cause the capacitor to discharge only through the first resistor, R1, thereby causing the oscillator circuit to have a duty cycle of R1/R2 so as to turn the LED 0N 1/X of the time and OFF (X−D/X) of the time.

13. A motion sensor as in claim 12 wherein X=10 and R1=10R2 such that the total resistance for charging the capacitor is R1·R2(R1+R2) and the total resistance for discharging the capacitor is R1, so as to cause the oscillator circuit to be ON 10% of the time and have a 10% duty cycle.

14. A motion sensor as in claim 1 wherein the weight is eccentrically coupled to the rotatable disk.

15. A motion sensor as in claim 1 wherein the motion sensor housing is worn by the user such that the plane of the rotatable disk is oriented 60° from the horizontal and lies along a line representing normal forward motion of the user thereby enabling the sensor to detect movement of the housing in at least one of two orthogonal planes.

16. A motion responsive alarm system to be worn by a user comprising:

a motion sensor for generating a signal responsive to motional disturbances;

an alternate state output signal device coupled to the motion sensor for receiving the generated signal and alternately switching its output between a first state and a second state only when motion is occurring;

an output device coupled to the alternate state device for generating a motion pulse each time the alternate state device switches from the first state to the second state;

a pulse interval timer coupled to the output device for blocking the first motion pulse generated and allowing succeeding pulses to be gated only if they occur at least at a prescribed rate, thus reducing sensitivity of the alarm system to vibratory movement not associated with movement of the user; and a reset timer for receiving the gated motion pulses and being reset by the gated pulses to preclude an alarm so long as motion pulses are generated.

17. A motion responsive alarm system as in claim 16 wherein the alternate state device comprises:

a capacitor;

a first circuit having an input coupled to the motion sensor and an output coupled to the capacitor for causing the capacitor to have a first voltage level when a motion pulse is detected; and a second circuit having an input coupled to the motion sensor and an output coupled to the capacitor for causing the capacitor to have a second voltage level when no motion pulse is detected.

18. A motion responsive alarm system as in claim 17 wherein:

the first circuit is a capacitor charging circuit; and the second circuit a capacitor discharging circuit.

19. A motion responsive alarm system as in claim 18 wherein the output device comprises:

a monostable pulse circuit coupled to the first and second circuits for generating the reset signal only when the capacitor voltage changes to the first level.

20. A motion responsive alarm system as in claim 18 wherein the motion sensor comprises:

an oscillator circuit for generating a pulse train;

a third circuit coupled to the oscillator circuit and the first circuit for generating pulses to charge the capacitor only when motion pulses are detected; and the second circuit having a second input coupled to the oscillator for receiving the pulse train such that the capacitor is discharged only when the capacitor charging pulses are absent and the oscillator signal is present.

21. A motion responsive alarm system as in claim 20 wherein the third circuit comprises:

an LED coupled to and driven by the oscillator to produce a train of light pulses;

a light detector spaced from the LED to receive light therefrom and generate the first pulse train; and a light interrupter between the LED and the light detector to intermittently block light from the LED to the light detector during motional disturbances.

22. A motion responsive alarm system as in claim 16 wherein said pulse interval timer is coupled between the output device and the reset timer to adjust the sensitivity of the system to both vibration and motion.

23. A motion responsive alarm system as in claim 22 wherein the pulse interval timer comprises:

a circuit inserted between the output device and the reset timer for establishing a pulse gate of predetermined width; and said pulse gate circuit generating a signal to reset the reset timer only when two adjacent pulses occur within the gate thereby reducing sensitivity of the system to both vibration and motion.

24. A motion responsive alarm system as in claim 16 further comprising:

a self-contained breathing apparatus including an oxygen source, a face mask and a conduit coupling the oxygen source to the mask;

a device mounted on the self-contained breathing apparatus for selectively enabling oxygen to be coupled from the source to the mask; and a switch responsive to operation of the oxygen enabling device for energizing the motion responsive alarm system only when oxygen is coupled from the source to the mask.

25. A motion responsive sensor alarm system comprising:

a motion sensor housing having a rotatable disk therein mounted for free rotation about an axis such that movement of the housing rotates the disk about said axis;

a plurality of spaced arcuately arranged orifices in the rotatable disk;

a light source on one side of the disk in alignment with the arcuate path formed by the orifices in the disk and a light detector on the other side of the disk such that light from the light source to the light detector through an orifice is interrupted by rotation of the disk when the housing is moved thereby causing the light detector to generate an output electrical signal;

a self-contained breathing apparatus for a user including an oxygen source, a face mask and a conduit coupling the oxygen source to the mask; and the motion sensor housing being attached to the self-contained breathing apparatus such that lack of motion by the user of the self-contained breathing apparatus causes the motion responsive sensor alarm system to generate an alarm.

26. A motion responsive alarm system as in claim 25 further including:

an alternate state device coupled to said light detector for receiving the generated electrical signal and alternately generating first state output and second state outputs only when motion is occurring;

an output device coupled to the alternate state device for generating a reset signal only when the alternate state device switches from the first state to the second state; and a timer coupled to the output device for receiving the reset signals, the timer being reset by the reset signals and generating an alarm signal only when the timer is not reset during a predetermined period of time.

27. A motion responsive alarm system as in claim 26 further including:

a gate circuit inserted between the output device and the timer for establishing a pulse gate of predetermined width; and said gate circuit generating a signal to reset the timer only when two adjacent reset pulses occur within the pulse gate thereby reducing sensitivity of the system to both vibration and motion.

28. A motion responsive alarm system as in claim 27 further including:

at least one slot, having a width, on the periphery of said rotatable disk;

an annular channel in the housing extending about the periphery of the disk;

a weight within the housing coupled to the freely rotatable disk for movement in the annular channel such that movement of the housing causes the weight to rotate the disk about its axis.

29. A motion responsive alarm system as in claim 28 wherein the gate circuit and the width of said at least one slot in the rotatable disk substantially eliminate sensitivity of the motion sensor to vibration.

* * * * *

UNITED STATES PATENT AND TRADEMARK OFFICE

CERTIFICATE OF CORRECTION

PATENT NO. : 5,438,320
DATED : Aug. 1, 1995
INVENTOR(S) : William R. Taylor

It is certified that error appears in the above-indentified patent and that said Letters Patent is hereby corrected as shown below:

Column 6, line 66, after "provides" and before "control", delete "a".

Column 8, line 35, "kilohertz" should read -- hertz --.

Column 14, line 36, "(X-D/X) should read -- (X-1)/X --.

Column 14, line 40, "R1·R2(R1+R2) should read -- R1·R2/(R1+R2) --.

Signed and Sealed this

Sixteenth Day of July, 1996

*Attest:*

*Attesting Officer*

BRUCE LEHMAN

*Commissioner of Patents and Trademarks*